United States Patent [19]

Miale

[11] Patent Number: 4,653,566

[45] Date of Patent: Mar. 31, 1987

[54] GARAGE DOOR SCREEN SYSTEM

[76] Inventor: Michael R. Miale, 4701 36th Ave. W., Bradenton, Fla. 33529

[21] Appl. No.: 790,617

[22] Filed: Oct. 23, 1985

[51] Int. Cl.[4] ..... E05D 15/16

[52] U.S. Cl. ..... 160/201; 160/99; 160/113

[58] Field of Search ..... 160/97, 99, 100, 101, 160/102, 103, 98, 106, 113, 114, 115, 116, 201, 202, 205, 40, 43

[56] References Cited

U.S. PATENT DOCUMENTS

| | | | |
|---|---|---|---|
| 1,550,879 | 8/1925 | Clark | 160/99 |
| 3,004,592 | 10/1961 | Norton | 160/114 |
| 3,226,144 | 12/1965 | Lomaz | 160/40 X |
| 3,304,994 | 2/1967 | Kozak | 160/202 |
| 3,339,619 | 9/1967 | Crosswell | 160/40 |
| 3,927,709 | 12/1975 | Anderson et al. | 160/116 X |
| 3,938,577 | 2/1976 | Richards | 160/113 X |
| 4,141,403 | 2/1979 | Church | 160/201 |
| 4,378,043 | 3/1983 | Sorenson | 160/201 X |
| 4,537,237 | 8/1985 | Sepulveda et al. | 160/201 |

*Primary Examiner*—Ramon S. Britts
*Assistant Examiner*—David M. Purol
*Attorney, Agent, or Firm*—Charles J. Prescott; Raymond H. Quist

[57] ABSTRACT

A garage door screen system is provided for a sectional garage door of the type which opens to an overhead position while supported by rollers contained in channels. The screen system is for a partially opened garage door and, in the preferred embodiment, provides separate screens for the bottom opening and the opening at the top which occurs as the door panels pivot inwardly. The bottom screen is alternately a rigid panel which is supported by vertical guides to the lowest door panel, or a window shade draw down type. A latch holds the lower rigid screen so that it does not extend below the door panel. When the latch is released, the screen panel will descend. The latch can be re-engaged merely by lowering the door. Torsion springs in the roller mechanism, automatically retract the screen secured to it when the latch holding the screen in its extended position is released. The top screen is attached at its top end to an upper cylinder which is secured to the door frame by pipe clamps. A lower cylinder is attached to the bottom end of the screen keeping it extended across the opening. This screen can be raised by rolling it about the lower cylinder. Alternatively, this upper screen may be left in its extended position without interfering with the opening and closing of the garage door. End and top covers are provided for the lower screen panel resulting in a system which will keep insects, etc. out, while permitting circulation of air.

14 Claims, 14 Drawing Figures

GARAGE DOOR SCREEN SYSTEM

BACKGROUND OF THE INVENTION

1. Field of the Invention

This invention relates generally to a screen system for a garage door, and more particularly to a screen system for a partially open overhead garage door.

2. Description of Related Art

Screens for garage door openings have generally been of three types: (1) a full screen door covering the entire door opening, (2) screen inserts in garage door panels and (3) screen sections for partially open garage doors.

The first type is exemplified by U.S. Pat. No. 3,021,896, by J. A. Buono et al, entitled: "Overhead Garage Door and Screen Combination". This example has a sectional screen door which can only be used when the garage door is fully opened.

An example of the screen insert type is shown in U.S. Pat. No. 3,178,776, by R. F. Stansberry, entitled: "Garage Door". In this patent, the door sections are divided into panels which have replaceable inserts, including screen inserts.

The third type of screen is shown in U.S. Pat. No. 4,378,043, by R. V. Sorenson, entitled: "Pivoting Screen Panel for Sectional Garage Door". This patent discloses an arrangement where a screen panel is hinged to the bottom section of the garage door and may be moved into position to cover the bottom opening when the door is partially opened. As indicated in this patent, the screen will keep out leaves, animals and people; and will also allow air to circulate; however, it will not keep out insects since no screen is provided for the opening which is created at the top of the door when the door is partially opened. Also, this screen only provides for a fixed height door opening.

A primary purpose of a screen system is to permit air to move through the screen while preventing insects or solid materials from passing through. A fully opened garage door, even with a screen, exposes to view the automobiles, tools, etc. contained therein. Since a screen does not present a substantial impediment to a would-be interloper, many prefer to leave the garage door only partially opened so that the contents of the garage are, for the most part, concealed. Moreover, regulation of the amount the door is to partially opened is desirable so that it can be varied to control the air flow.

It is therefore a primary object of this invention to provide a garage door screen system which will permit a range of garage door openings to provide air flow of a desired level.

It is therefore an object of this invention to provide a garage door screen system which will provide screening for both the bottom and the top of a partially opened sectional garage door so as to permit circulation of air into the garage while preventing insects, snakes, debris, etc. from passing through.

It is also an object of this invention to provide a garage door screen system which will not present an inconvenience in opening and closing the garage door.

SUMMARY OF THE INVENTION

A garage door screen system incorporates a rigid screen panel which can be moved from a retracted position in which it is stored on the backside of the bottom door section, to an extended position where it covers the lower opening which results when the garage door is partially opened. The screen panel moves on rollers in channels and latching means is provided for releaseably holding the screen panel in its retracted position. The system may additionally incorporate an upper screen which may be stored outside the door at the top of or above the door opening, and which may be extended across the upper opening which results when the garage door is partially opened or left in the extended position without interfering with garage door opening and closing. Provision is made for closing the gaps between the rigid screen panel and the door frame and that between the screen panel and the lower door section.

DETAILED DESCRIPTION OF THE INVENTION

Referring to FIGS. 1, 1A, 2 and 3, a detail of sectional garage door 10 is shown at the side adjacent to garage wall 12. In the conventional manner, channel 14 is secured to garage wall 12 providing a guide for the rollers which are attached to the garage door sections. Roller 16 is one such roller in channel 14. Molding 18, which is secured to garage wall 12, provides a surface acting as a seal between the garage door and the wall. It should be understood that wall 12 is only representative and includes a frame for the door opening. All of the foregoing structure is intended to represent a conventional sectional garage door arrangement in which four or so horizontal panels make up the garage door, and the door opens on rollers moving in channels to an overhead position from a fully closed position.

Figure 1:
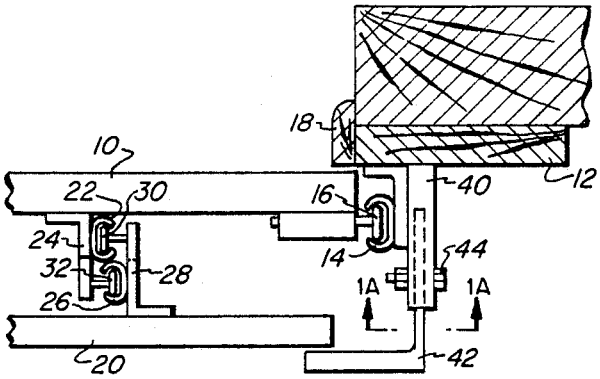
FIG. 1 is a plan view, partially in section, of a first portion of a screen system in accordance with the invention.
Figure 1A:
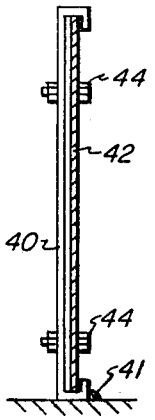
FIG. 1A is an elevation in cross-section of a detail of FIG. 1.
Figure 2:
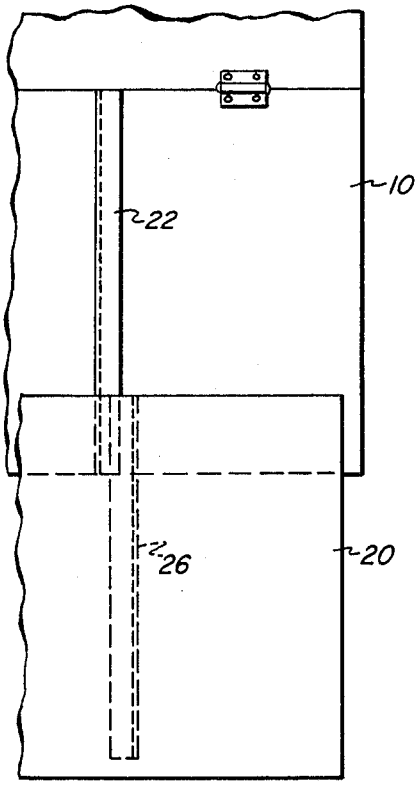
FIG. 2 is an elevation of parts of the screen system shown in FIG. 1 fully extended.
Figure 3:
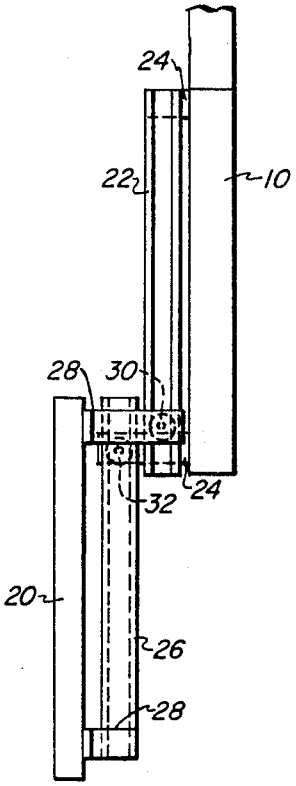
FIG. 3 is a side elevation of parts of the screen system shown in FIG. 1.
Figure 4:
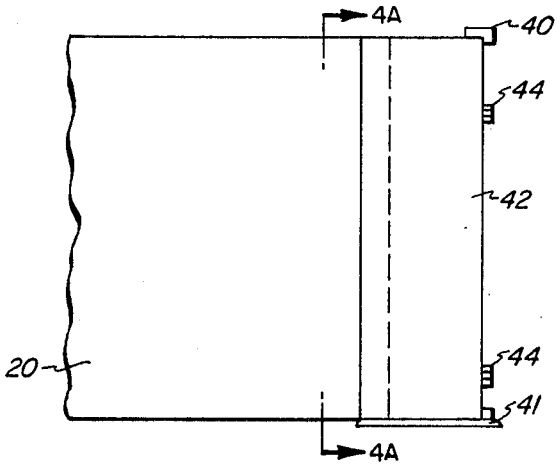
FIG. 4 is an elevation of additional parts of the screen system shown in FIG. 1.
Figure 4A:
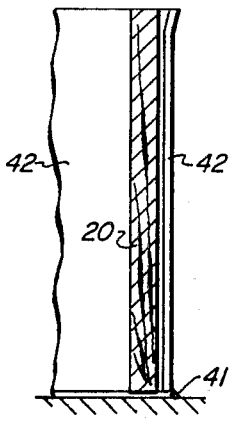
FIG. 4A is an elevation in cross-section of a detail of FIG. 4.

In accordance with the invention, rigid screen panel 20 is positioned parallel to the lower garage door section 10, and is supported by garage door 10 so that it can move from a fully retracted position in which the bottom of rigid screen panel 20 does not extend below the bottom of lower garage door section 10, to an extended postion in which it extends (no more than 14 inches in the embodiment contemplated) below the bottom of lower garage door section 10, as shown in FIGS. 2 and 3. A first vertical channel 22 is secured to lower garage door section 10 by brackets 24 which may extend the full length. A second vertical channel, not shown, is secured to the other end of lower garage door section 10 in a similar manner. Additional channels may be secured to lower garage door section 10 intermediate the ends. Such additional channels are desirable when the garage door is extra wide as for one used with a two car garage.

A third vertical channel 26 is secured to rigid screen panel 20 by brackets 28 which may extend the full length. A fourth vertical channel, not shown, is secured to the other end of rigid screen panel 20 in a similar manner. If additional channels, are included on the door, obviously additional complementary channels would be incorporated on the screen panel.

A first roller 30 is positioned to roll in first vertical channel 22, but is mounted on upper bracket 28 or full length angle which is secured to rigid screen panel 20. A second roller, not shown, is similarly positioned to roll in the second vertical channel, but is also mounted on a bracket or full length angle to rigid screen panel 20. A third roller 32, is positioned to roll in third vertical channel 26, but is mounted on lower bracket 24 which is secured to lower garage door section 10. A fourth roller, not shown, is similarly positioned to roll in the fourth vertical channel, but is also mounted on a bracket secured to lower garage door section 10. These channel and roller arrangements are of the type sometimes used with drawers.

Although channel and roller arrangements such as those shown provide a smooth and easy movement, of rigid screen panel 20 between its retracted and extended positions, it will be evident that other arrangements for performing the same function may be substituted. It should be noted that garage door 10 can be opened to any position not exceeding the full extension of screen panel 20 while still having the advantages of a screen covered opening. Thus, in colder or inclement weather, only a small opening may be needed to provide a desired degree of air circulation.

In order not to obscure the arrangement and operation of the apparatus, not every component is shown in every figure of drawings. Referring now to FIGS. 1, 1A, 4 and 4A rigid screen panel 20 is shown to have a two piece end cover which closes the end gaps between wall or door frame 12 and rigid screen panel 20. First angle panel 40 is secured to wall or door frame 12. Caulking 41 is used to close any gap at the garage floor. Second angle panel 42 is secured to first angle panel 40 by bolts 44. It is preferred that bolt holes in one or the other panel be slotted so that a close fit between first angle panel 42 and rigid screen panel 20 can be achieved. In lieu of securing the two piece end cover to wall or door frame 12, in some cases it may be secured to rigid screen panel 20. A similar two piece panel end cover arrangement is provided at the other end of rigid screen panel 20.

Figure 5:
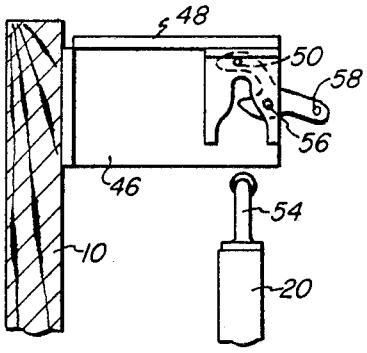
FIG. 5 is a side elevation showing a latch mechanism.
Figure 6:
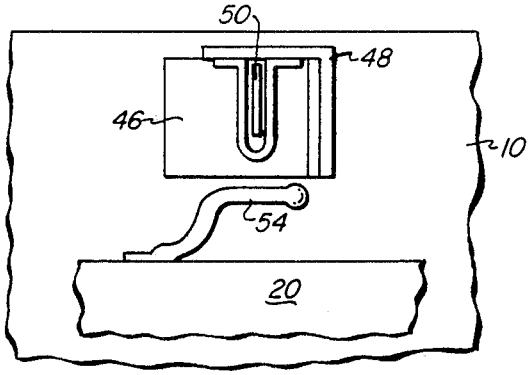
FIG. 6 is an elevation of the latch mechanism of FIG. 5.

With the arrangement as so far described, rigid screen panel 20 will slide to its extended position if garage door 10 is raised. To hold rigid screen panel 20 in its retracted position, a latch, such as the latch shown in FIGS. 5 and 6 is provided. Secured to garage door 10 is a first angle member 46. A second angle member 48 is secured to first angle member 46 and extends out above rigid screen panel 20. A latch housing 50 is secured to second angle member 48. Keeper 52, pivoted in latch housing 50, is of the type which will be moved outwardly when the striker hits it, and then will fall back into position, holding the striker. Striker 54 is secured to the top of rigid screen panel 20 in a position to enter latch housing 50 when garage door 10 descends. A first hole 56 in keeper 52 is provided to receive a pin (not shown) when it is desired to leave the latch mechanism in an unlocked position, i.e. so that rigid screen panel 20 will descend as the door is opened. A second hole 58 in keeper 52 is located so that a remotely controlled device such as a solenoid can be attached to release the latch.

Figure 7:
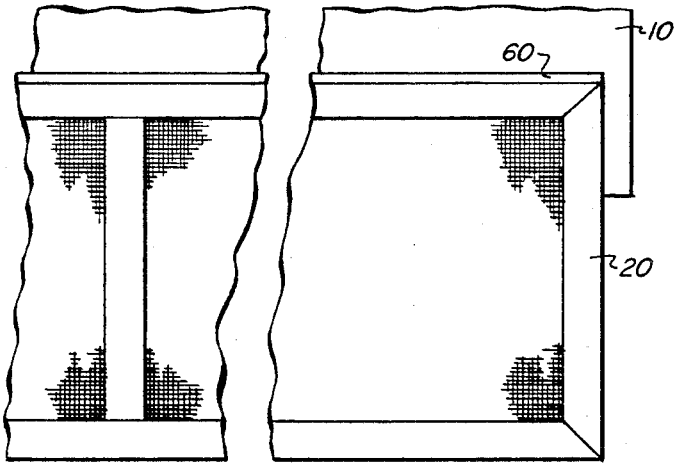
FIG. 7 is an elevation showing the screen panel and top seal.
Figure 8:
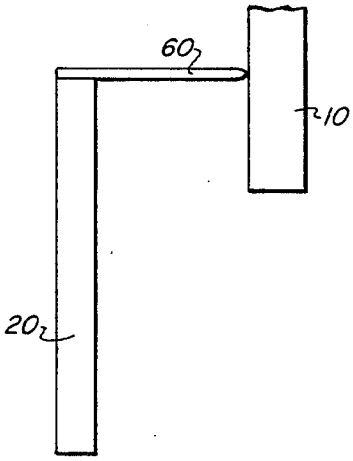
FIG. 8 is a side elevation of FIG. 7.

Turning next to FIGS. 7 and 8, rigid screen panel 20 and garage door 10 are shown in their parallel relationship. Secured to the top of rigid screen panel 20 is flexible top cover 60 which closes the top gap between rigid screen panel 20 and garage door 10.

Figure 9:
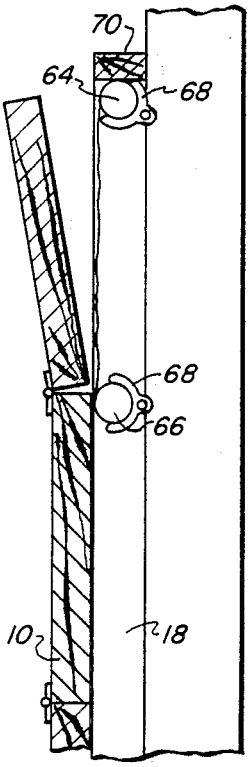
FIG. 9 is a side elevation showing another portion of the screen system in accordance with the invention.
Figure 10:
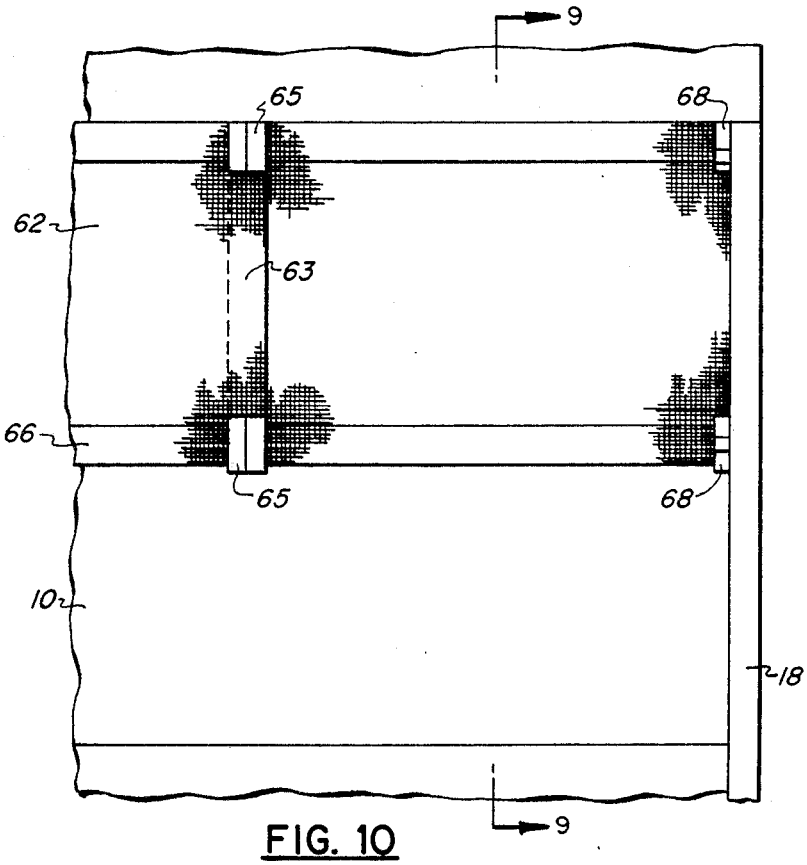
FIG. 10 is a front elevation of FIG. 9.

The screen system heretofore described will close the bottom opening against insects, etc. when the garage door is partially opened; however, an additional opening is developed at the top of the door as the garage door panels pivot into the garage as they near the top of the door opening. In FIGS. 9 and 10 molding 18 (also shown in FIG. 1) and garage door 10 are shown. The upper panel of garage door 10 is pivoted partially inward. In accordance with the invention, screen 62 extends across the garage door opening and extends vertically across the pivoted panel of garage door 10, thereby closing the opening against insects and the like, while permitting air to circulate therethrough. Screen 62, in this embodiment, is secured at the top and bottom to cylinders 64 and 66, respectively. Two or more pipe clamps 68 are used to secure cylinder 64 to top molding 70 or side molding 18 as shown. If desired, screen 62 can be raised by rolling it about cylinder 66, or it may be left extended as it will not interfere with opening garage door 10. Screen 62 is shown as having an overlap 63 and is held in place by clamps 65 to cylinders 64 and 66.

When the screen system of this invention is extended, and it is desired to open the garage door, after the pin is removed from hole 56, the garage door is first moved to the fully closed position so that the latching mechanism is engaged and the screen is moved to its fully retracted position. The door is then raised in the customary manner. This sequence may be performed with an automatic garage door opening device or manually.

To put the screen in its extended position, the latch mechanism is opened, the pin inserted in hole 56 and the garage door raised.

Figure 11:
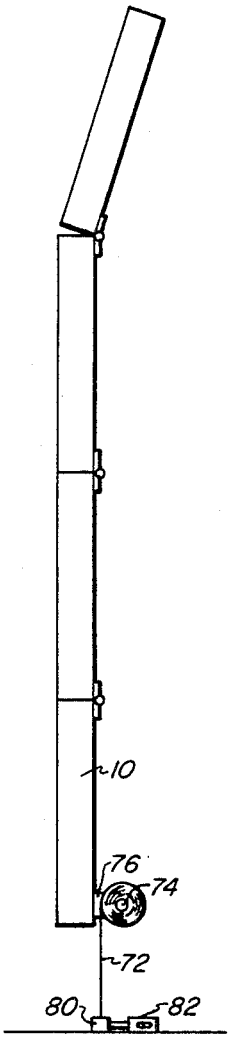
FIG. 11 is a side elevation of an alternate embodiment of the invention.
Figure 12:
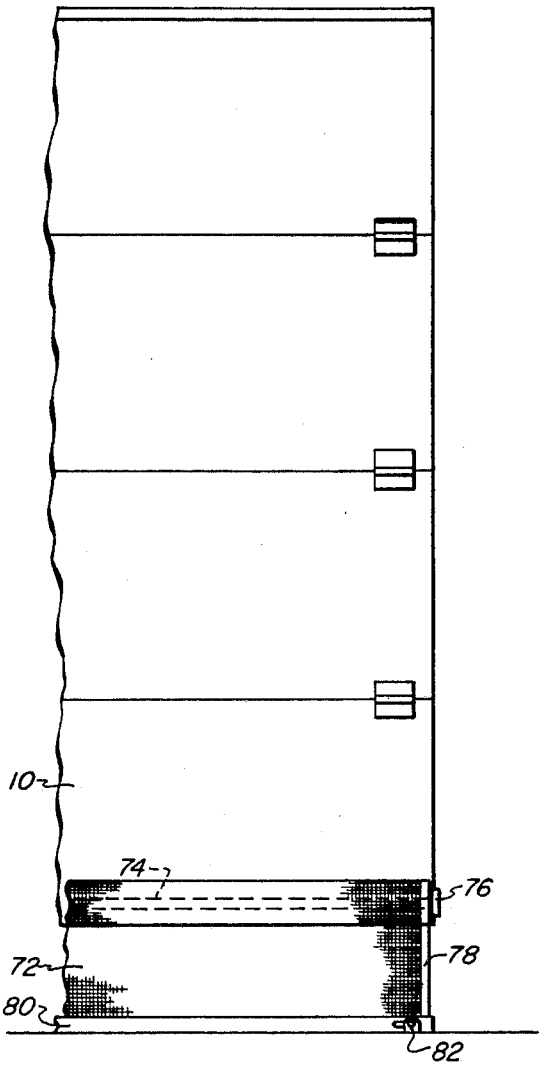
FIG. 12 is a front elevation of FIG. 11.

Referring now to FIGS. 11 and 12, an alternate garage door screen system is disclosed. Sectional garage door 10 has secured to it near the inside bottom, screen 72 which is secured to roller mechanism 74. Roller mechanism 74 is of the familiar type used with window shades and is supported at the ends by brackets 76. The sides of screen 72 may be reinforced with a strip of flexible material 78 to cover loose screen edges. Screen 72 is held at the bottom between bars 80. Bars 80 may be fastened to the garage floor using releaseable fasteners 82. As with the embodiment in FIGS. 1–8, this embodiment permits the screened opening to be varied in height so as to provide the desired degree of air circulation.

Although one embodiment of a garage door screen system has been illustrated and described, it will be apparent to those skilled in the art that modifications may be made. It is intended that the appended claims cover all such modifications falling within the spirit of the invention and the scope of the claims.

I claim:

1. In combination with a sectional garage door moveable to close a garage door opening, said garage door opening defined by a door frame and a garage floor, said garage door having a plurality of horizontally extending rectangular sections disposed one above the other, each of said sections having a top edge and a bottom edge and hinges connecting the top edge of each section to the bottom edge of the section disposed above it, the bottom door section of said sections moveable vertically up to partially open said garage door creating an opening between said garage floor and said bottom edge of said bottom section, the top door section of said sections movable simultaneously with said bottom section to pivot about said hinge on said bottom edge of said top door section creating an opening between said door frame and said top door section, a garage door screen system comprising:

a rigid, horizontally extending, rectangular screen panel;

said screen panel having a rectangular frame with a top member, a bottom member, and vertically extending lateral side members;

a first set of vertical guides secured to the inside of said bottom door section;

a second, complementary set of vertical guides secured to said side members of said screen panel;

a first set of rollers positioned in said first set of vertical guides and secured to said one side of said screen panel;

a second set of rollers positioned in said second set of vertical guides and secured to said inside of said bottom door section; whereby said screen panel can be moved parallel to said bottom door section from a retracted position in which the bottom edge of said screen panel does not extend below the bottom edge of said bottom door section, to an extended position in which the bottom edge of said screen panel extends below the bottom edge of said bottom door section.

2. A garage door screen system in accordance with claim 1 further including:

an upper screen secured to the door frame outside the door opening; and means for extending said upper screen across the opening which results when the garage door is partially opened.

3. A garage door screen system in accordance with claim 1 further including:

an upper screen secured to the door frame outside the door opening and extending across the opening which results when the garage door is partially opened.

4. A garage door screen system in accordance with claim 1 further including:

latching means releasably holding said rigid screen panel in its retracted position.

5. A garage door screen system in accordance with claim 1 further including:

end covers closing the end gap between said rigid screen panel and the door frame; and a top gap cover closing the top gap between said rigid screen panel and the garage door.

6. A garage door screen system in accordance with claim 2 wherein:

said upper screen is secured to the door frame outside the door opening on a cylinder secured by pipe clamps.

7. A garage door screen system in accordance with claim 4 wherein:

said latching means includes a striker secured to the top of said rigid screen panel and a keeper secured to the garage door; and said keeper will automatically engage said striker when the garage door is lowered.

8. A garage door screen system in accordance with claim 4 wherein:

said latching means includes a pivoted keeper and said keeper is provided with a pin receiving opening, whereby said latching means can be maintained in an open position.

9. In combination with a sectional garage door moveable to close a garage door opening, said garage door opening defined by a door frame and a garage floor, said garage door having a plurality of horizontally extending rectangular sections disposed one above the other, each of said sections having a top edge and a bottom edge and hinges connecting the top edge of each section to the bottom edge of the section disposed above it, the bottom door section of said sections moveable vertically up to partially open said garage door creating an opening between said garage floor and said bottom edge of said bottom section, the top door section of said sections movable simultaneously with said bottom section to pivot about said hinge on said bottom edge of said top door section creating an opening between said door frame and said top door section, a garage door screen system comprising:

an upper screen section, for the upper opening which results when the sectional garage door is partially opened, secured to the outside portion of the door frame;

a lower screen section for the lower opening which results when the sectional garage door is partially opened;

said upper screen section moveable from a stored position above said upper opening to a extended position extending across said upper opening;

said lower screen section having a rectangular frame with a top member, a bottom member, and vertically extending lateral side members;

a first set of vertical guides secured to the inside of said bottom door section;

a second, complementary set of vertical guides secured to said side members of said screen panel;

a first set of rollers positioned in said first set of vertical guides and secured to said one side of said screen panel;

a second set of rollers positioned in said second set of vertical guides and secured to said inside of said bottom door section; whereby said screen panel can be moved parallel to said bottom door section from a retracted position in which the bottom edge of said screen panel does not extend below the bottom edge of said bottom door section, to an extended position in which the bottom edge of said screen panel extends below the bottom edge of said bottom door section.

10. A garage door screen system in accordance with claim 9 further including:

latching means releasably holding said lower screen section in its retracted position.

11. A garage door screen system in accordance with claim 9 further including:

end covers closing the end gap between said lower screen panel and the door frame; and a top gap cover closing the top gap between said lower screen panel and said bottom door section.

12. A garage door screen system in accordance with claim 9 wherein:

said lower screen section is a rigid panel.

13. A garage door screen system in accordance with claim 9 further including:

a roller mechanism attached to said bottom door section; and said lower screen section is retractably mounted on said roller panel.

14. In combination with a sectional garage door moveable to close a garage door opening, said garage door opening defined by a door frame and a garage floor, said garage door having a plurality of horizontally extending rectangular sections disposed one above the other, each of said sections having a top edge and a bottom edge and hinges connecting the top edge of each section to the bottom edge of the section disposed above it, the bottom door section of said sections moveable vertically up to partially open said garage door creating an opening between said garage floor and said bottom edge of said bottom section, the top door section of said sections movable simultaneously with said bottom section to pivot about said hinge on said bottom edge of said top door section creating an opening between said door frame and said top door section, a garage door screen system comprising:

a rigid screen panel;

first and second vertical channels secured to the inside of the bottom door section;

third and fourth vertical channels secured to one side of said rigid screen panel;

first and second channel rollers secured to said one side of said rigid screen panel in positions to roll in said first and second channels respectively;

third and fourth channel rollers secured to said inside of the bottom door section in positions to roll in said third and fourth channels respectively, whereby said screen panel can be moved from a retracted position in which the bottom of said screen panel does not extend below the bottom of the bottom door section, to an extended position in which it will below the bottom of the door section;

a bar secured to the top of said rigid screen panel;

a latch secured to the inside of the bottom door section near the top thereof for releasable engaging said bar;

end covers closing the end gaps between the door frame and said rigid screen panel;

flexible means closing the horizontally extending gap between said rigid screen panel and the bottom door section when said rigid screen panel is extended;

an upper screen secured to the door frame outside the door opening; and means for extending said upper screen across the opening which results when the garage door is partially opened.

* * * * *